US005612501A

United States Patent [19]

Kondo et al.

[11] Patent Number: 5,612,501

[45] Date of Patent: Mar. 18, 1997

[54] AUTOMATIC ACCOMPANIMENT INFORMATION PRODUCING APPARATUS

[75] Inventors: Masao Kondo; Shinichi Ito; Hiroki Nakazono, all of Hamamatsu, Japan

[73] Assignee: Yamaha Corporation, Japan

[21] Appl. No.: 409,717

[22] Filed: Mar. 24, 1995

[30] Foreign Application Priority Data

Mar. 24, 1994 [JP] Japan ..... 6-053597

[51] Int. Cl.[6] ..... G10H 1/38; G10H 7/00

[52] U.S. Cl. ..... 84/637; 84/619; 84/657; 84/669

[58] Field of Search ..... 84/609, 613, 619, 84/634, 637, 657, 666, 669

[56] References Cited

U.S. PATENT DOCUMENTS 5,159,141 10/1992 Iba ..... 84/613 X
5,296,643 3/1994 Kuo et al. ..... 84/610
5,313,011 5/1994 Koguchi ..... 84/609
5,477,003 12/1995 Muraki et al. ..... 84/610

FOREIGN PATENT DOCUMENTS 5-257470 10/1993 Japan .

*Primary Examiner*—William M. Shoop, Jr.
*Assistant Examiner*—Jeffrey W. Donels
*Attorney, Agent, or Firm*—Graham & James LLP

[57] ABSTRACT

In an automatic accompaniment information producing apparatus, tone pitch information of an accompaniment pattern applied from an external device is converted in tone pitch in accordance with a designation chord, an original chord based on the accompaniment pattern and attribute information of the tone pitch information, the converted tone pitch information is produced as automatic accompaniment information.

11 Claims, 7 Drawing Sheets

FIG.3

TBL (TBLN, TR) SETTING TABLES

| TR | ENB | ICH | OCH | TC | RT | TP | LLM | HLM |
|---|---|---|---|---|---|---|---|---|
| 0 | 1 | 3 | 5 | PIANO | C | Maj | C3 | B4 |
| 1 | 1 | 2 | 6 | WOOD BASS | D | Min | C0 | C2 |
| 2 | 0 | - | - | - | - | - | - | - |
| ⋮ | ⋮ | ⋮ | ⋮ | ⋮ | ⋮ | ⋮ | ⋮ | ⋮ |

FIG.4

AVSCHL (TP, NT) CLASSIFICATION TABLE

| | NT | 0 | 1 | 2 | 3 | 4 | 5 | 6 | 7 | 8 | 9 | 10 | 11 |
|---|---|---|---|---|---|---|---|---|---|---|---|---|---|
| TP | | C | C# | D | D# | E | F | F# | G | G# | A | A# | B |
| 0 | Maj | c | n | s | n | c | n | n | c | n | s | n | n |
| ⋮ | ⋮ | | | | | | ⋮ | | | | | | |
| 20 | 7 - 9 | c | n | c | n | n | s | n | c | s | n | c | n |

FIG.5A

NTT (0, TP, NT) CHORD TONE (C) NOTE CONVERSION TABLE

| TP ↓ | | | NAME OF TONE | | | | | | | | | | | |
|---|---|---|---|---|---|---|---|---|---|---|---|---|---|---|
| | | | C | C# | D | D# | E | F | F# | G | G# | A | A# | B |
| TYPE OF CHORD | 1 | Maj | 0 | -1 | -2 | -3 | -4 | 7 | 6 | 5 | 4 | 3 | 2 | 1 |
| | ⋮ | ⋮ | | | | | | ⋮ | | | | | | |
| | 20 | 7 - 9 | 2 | 1 | 0 | -1 | -2 | 3 | -4 | 7 | 6 | 5 | 4 | 3 |

FIG.5B

NTT (1, TP, NT) SCALE TONE (S) NOTE CONVERSION TABLE

| TP ↓ | | | NAME OF TONE | | | | | | | | | | | |
|---|---|---|---|---|---|---|---|---|---|---|---|---|---|---|
| | | | C | C# | D | D# | E | F | F# | G | G# | A | A# | B |
| TYPE OF CHORD | 1 | Maj | 0 | -1 | 0 | -1 | 0 | -1 | 1 | 0 | -1 | 0 | -1 | 1 |
| | ⋮ | ⋮ | | | | | | ⋮ | | | | | | |
| | 20 | 7 - 9 | 0 | -1 | 0 | -1 | 1 | 0 | -1 | 0 | 0 | -1 | 0 | -1 |

FIG.5C

NTT (2, TP, NT) NON-SCALE TONE (N) NOTE CONVERSION TABLE

| TP ↓ | | | NAME OF TONE | | | | | | | | | | | |
|---|---|---|---|---|---|---|---|---|---|---|---|---|---|---|
| | | | C | C# | D | D# | E | F | F# | G | G# | A | A# | B |
| TYPE OF CHORD | 1 | Maj | -1 | 0 | 0 | 0 | -1 | 0 | 0 | -1 | 0 | 0 | 0 | 0 |
| | ⋮ | ⋮ | | | | | | ⋮ | | | | | | |
| | 20 | 7 - 9 | -1 | 0 | -1 | 0 | 0 | 0 | 0 | -1 | 0 | 0 | -1 | 0 |

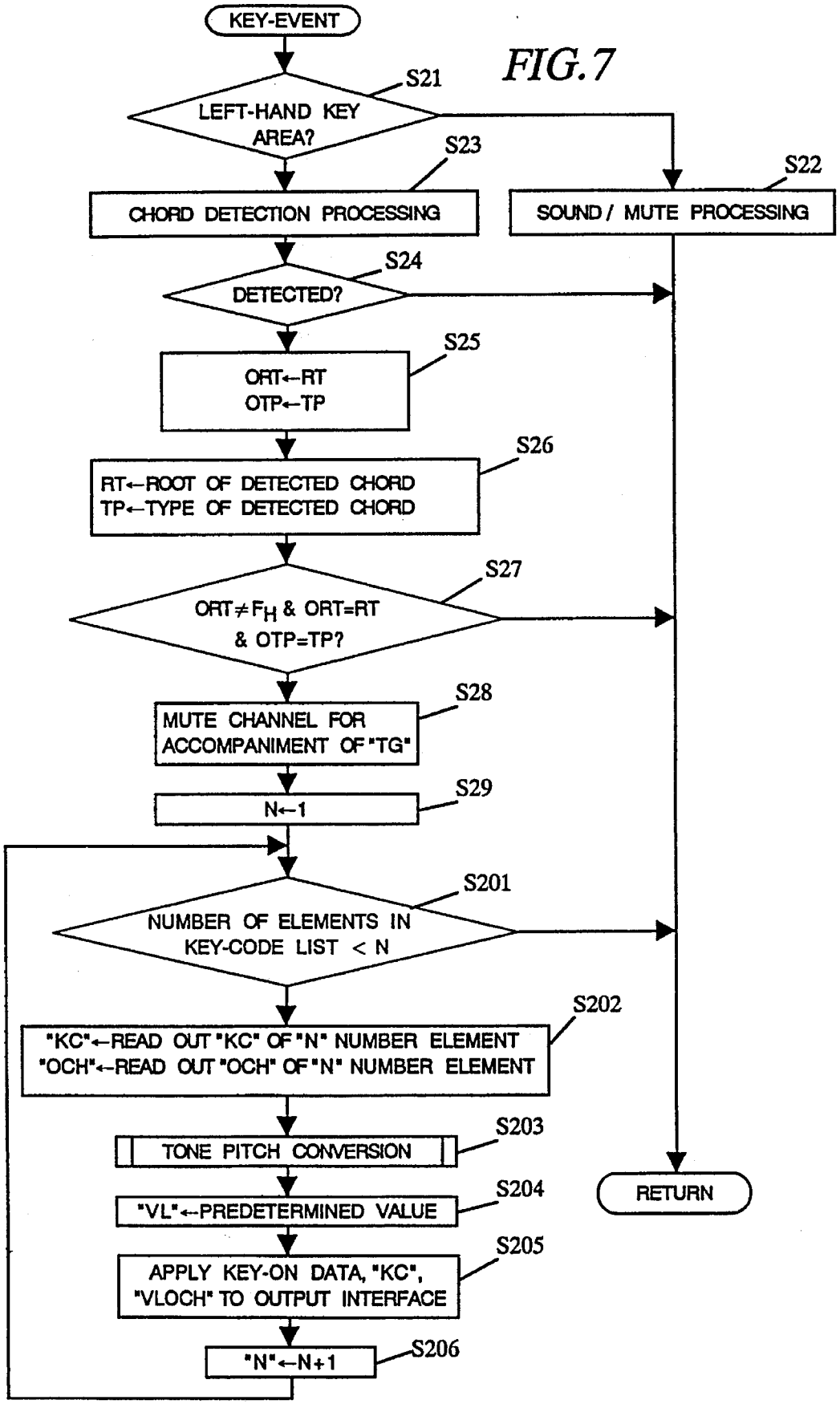
KEY-EVENT
FIG. 7
S21
LEFT-HAND KEY AREA?
S23
CHORD DETECTION PROCESSING
S22
SOUND / MUTE PROCESSING
S24
DETECTED?
S25
ORT←RT
OTP←TP
S26
RT←ROOT OF DETECTED CHORD
TP←TYPE OF DETECTED CHORD
S27
ORT≠FH & ORT=RT & OTP=TP?
S28
MUTE CHANNEL FOR ACCOMPANIMENT OF "TG"
S29
N←1
S201
NUMBER OF ELEMENTS IN KEY-CODE LIST < N
S202
"KC"←READ OUT "KC" OF "N" NUMBER ELEMENT
"OCH"←READ OUT "OCH" OF "N" NUMBER ELEMENT
S203
TONE PITCH CONVERSION
S204
"VL"←PREDETERMINED VALUE
S205
APPLY KEY-ON DATA, "KC", "VLOCH" TO OUTPUT INTERFACE
S206
"N"←N+1
RETURN

AUTOMATIC ACCOMPANIMENT INFORMATION PRODUCING APPARATUS

BACKGROUND OF THE INVENTION

1. Field of the Invention

The present invention relates to an automatic accompaniment information producing apparatus for producing accompaniment information for an automatic accompaniment, more particularly to an automatic accompaniment information producing apparatus for effecting an automatic accompaniment based on an accompaniment pattern preliminarily applied by a user.

2. Description of the Prior Art

In an electronic musical instrument of the keyboard type provided with a conventional automatic accompaniment apparatus of this kind, an accompaniment pattern is preliminarily memorized by a user in accordance with various styles or genres of a musical tune such as rock or country music to effect automatic accompaniment based on the memorized pattern in synchronism with an input chord applied from the keyboard. There has been also proposed an automatic accompaniment apparatus which is arranged to memorize an accompaniment pattern newly produced by a player for effecting automatic accompaniment based thereon.

In such conventional automatic accompaniment apparatuses, a desired accompaniment pattern may not be produced since it is difficult for the user to produce a new accompaniment pattern, and various variation of the automatic accompaniment may not be effected due to limitation of the memorized accompaniment pattern.

SUMMARY OF THE INVENTION

It is, therefore, a primary object of the present invention to provide an automatic accompaniment apparatus capable of effecting various automatic accompaniments in abundance on a basis of a desired accompaniment pattern supplied thereto from an external automatic performance device.

According to The present invention, the object is accomplished by providing an automatic accompaniment information producing apparatus which comprises first input means arranged to be applied with tone pitch information of an accompaniment pattern from an external device, second input means arranged to be applied with a designation chord, first supply means for supplying an original chord based on the accompaniment pattern, second supply means for supplying attribute information of the tone pitch information of the accompaniment pattern, tone pitch conversion means for converting in tone pitch the tone pitch information of the accompaniment pattern in accordance with the designation chord, the original chord and the attribute information respectively supplied from the second input means, the first supply means and the second supply means, and output means for producing the converted tone pitch information of the accompaniment pattern as automatic accompaniment information.

According to an aspect of the present invention, there is provided an automatic accompaniment information producing apparatus which comprises first input means having a plurality of channels arranged to be applied with tone pitch information of an accompaniment pattern from an external device, second input means arranged to be applied with a designation chord, supply means for supplying an original chord based on the accompaniment pattern and corresponding with each channel of the first input means, tone pitch conversion means for converting in tone pitch the tone pitch information of the accompaniment pattern in accordance with the designation chord and the original chord respectively supplied from the second input means and the supply means, and output means for producing the converted tone pitch information of the accompaniment pattern as automatic accompaniment information.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIG. 3 illustrates a setting table memorized in a setting table memory shown in FIG. 2;

FIG. 4 illustrates a classification table memorized in a classification table memory shown in FIG. 2;

FIGS. 5(A)–5(C) illustrate note conversion tables memorized in a note conversion table memory shown in FIG. 2;

FIG. 7 is a flow chart of a key-event routine of the control program;

DESCRIPTION 0F THE PREFERRED EMBODIMENT

Figure 1:
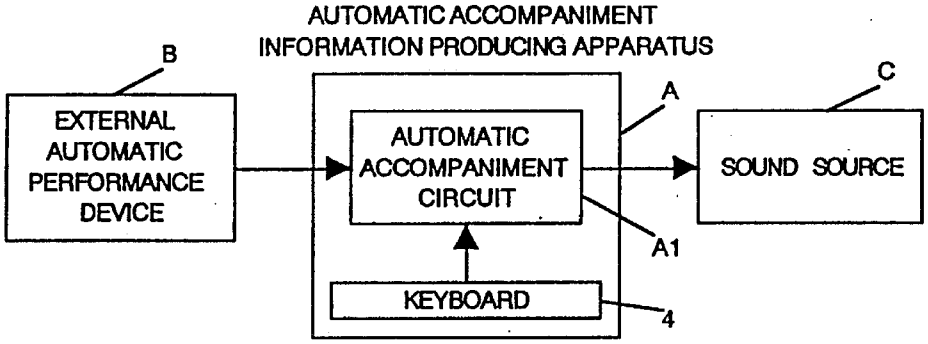
FIG. 1 is a block diagram of an automatic accompaniment system provided with an automatic accompaniment information producing apparatus in accordance with the present invention.

In FIG. 1 of The drawings, there is illustrated a block diagram of a preferred embodiment of an automatic accompaniment system provided with an automatic accompaniment information producing apparatus A in accordance with the present invention. The automatic accompaniment information producing apparatus A includes a chord input means in the form of a keyboard 4 and an automatic accompaniment circuit A1 composed of an input means, a tone pitch conversion means and an accompaniment information output means. In the automatic accompaniment system, the automatic accompaniment information producing apparatus A, an external input means in the form of an external automatic performance device B and an external output means in the form of a sound source C are connected to one another by means of a MIDI interface (Musical Instrument Digital Interface) for receiving an accompaniment pattern from the external automatic performance device B and transmitting automatic accompaniment information to the external output means when applied with a MIDI signal.

The automatic accompaniment circuit A1 includes a memory for memorizing tone pitch conversion information based on a standard chord such as C Major 7 in the form of a note conversion table and for memorizing a chord and range standardized by an accompaniment pattern produced by a player in the form of plural setting tables. The external automatic performance device B is operated by the player to produce the accompaniment pattern based on a desired chord, and the setting tables of automatic accompaniment circuit A1 are selectively set In accordance with the produced accompaniment pattern. When applied with the accompaniment pattern from the external automatic performance device B, the automatic accompaniment circuit A1 converts tone pitch information (key-codes) of the accompaniment pattern on a basis of a set value in the selected setting table, a chord applied from the keyboard 4 and the note conversion table and applies the converted tone pitch information to the sound source C as automatic accompaniment information.

In the MIDI standard of this embodiment, a plurality of input-output devices are allotted to a plurality of MIDI channels to be selectively designated by a channel number applied thereto. The MIDI channels are utilized to conduct performance of plural parts by means of a single sound source. In this embodiment, the sound source C is arranged to set different tone colors at the respective MIDI channels for producing u musical sound of a tone color designated by the channel number. Thus, the sound source C produces a musical sound of tone pitch, tone color and velocity (tone volume) defined by the automatic accompaniment information supplied from the automatic accompaniment circuit A1. Although in this embodiment, the external automatic performance device B and the sound source C are adapted respectively as an external input means and an external output means, the external input means may be arranged to supply an accompaniment pattern produced by a user, and the external output means may be arranged to produce a musical sound based on automatic accompaniment information applied thereto.

Figure 2:
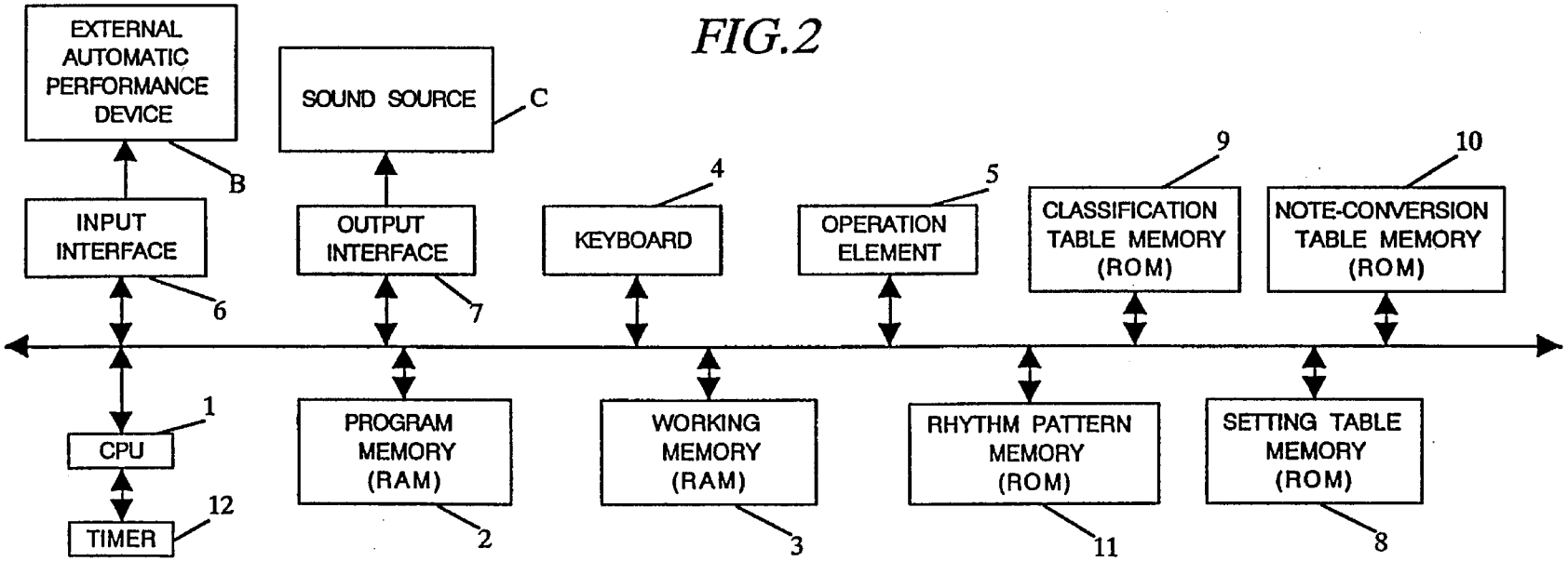
FIG. 2 is a block diagram of the automatic accompaniment information producing apparatus shown in FIG. 1.

In FIG. 2 there is illustrated a block diagram of the automatic accompaniment information producing apparatus A which includes a central processing unit or CPU 1 arranged to execute a control program stored in a program memory 2 by using a working area of a working memory 3. The CPU 1 executes input processing of keyboard performance caused by operation of the keyboard 4 and data caused by operation of an operation element 5 such as a panel switch and executes input processing of an accompaniment pattern applied from the external automatic performance device B through an input interface 6. The CPU 1 further executes processing for tone pitch conversion of the accompaniment pattern and executes output processing of automatic accompaniment information applied to the sound source C through an output interface 7. In addition, the input Interface 6 and output interface 7 each are In the form of a MIDI interface provided with a buffer for temporarily memorizing a MIDI signal. The standard MIDI signal is produced to provide a command signal of one byte called as a channel voice message, a tone color number, a note-code (a key-code) and velocity of an initial touch, etc. The command signal includes a key-on data for sound designation, a key-off data for mute designation, etc. The command signal of one byte includes channel numbers of the MIDI channel.

In this embodiment, the CPU 1 is applied with the accompaniment pattern from the external automatic performance device B by processing of the MIDI signal. When applied with a key-on data by the command signal, the CPU 1 applies the key-on data, a channel number, a key-code and velocity to the output interface 7 for sound designation. When applied with a key-off data by the command signal, the CPU 1 applies the key-off data, a channel number and a key-code to the output interface 7 for mute designation.

The keyboard 4 is imaginarily subdivided into a left-hand key area for bass and a right-hand area for treble. In operation, the CPU 1 conducts sound processing or mute processing of a key-event at the right-hand key area and detects a designation chord on a basis of key-codes detected by a key-on event at the left-hand key area. The operation element 5 is provided with a switch for output requirement of the accompaniment pattern, a switch for setting the contents of the setting tables, a selection switch for selecting the setting tables and other switches. When one of the switches is operated by operation of the operation element 5, the CPU 1 executes processing of the operation event of the switch.

As shown in FIG. 3, a setting table memory 8 is designed to memorize an enable flag ENB indicative of validity/invalidity of a track designated by each track number corresponding with each part of the accompaniment pattern, an input channel number ICH, an output channel number OCH, a tone color number TC, the root RT and type TP of an original chord to be designated by a user chord for production of each accompaniment pattern, a lower limit tone LLM and an upper limit tone HLM of an accompaniment tone in the form of a setting table. In addition, each of the setting tables TBL(TBLN,TR) is selected by a selection table number TBLN.

As is shown in the following table, scales available for the type of chord are respectively determined. With respect to these scales, a chord constituent tone, a tone on the scale except for the chord constituent tone and a tone except for the scale are determined as attributes such as a chord tone (c), a scale tone (s) and a non-scale tone (n) in relation to tone names (C, C#, D, D#, . . . ).

TABLE

| TYPE OF CODE | SCALE | C | C# | D | D# | E | F | F# | G | G# | A | A# | B |
|---|---|---|---|---|---|---|---|---|---|---|---|---|---|
| Maj | Ionian | c | n | s | n | c | s | n | c | n | s | n | s |
| | Lydian | c | n | s | n | c | n | s | c | n | s | n | s |
| | Mixolydian | c | n | s | n | c | s | n | c | n | s | s | n |
| | result | c | n | s | n | c | n | n | c | n | s | n | n |
| : | : | | | | | | | : | | | | | |
| : | : | | | | | | | : | | | | | |
| : | : | | | | | | | : | | | | | |
| 7–9 | Mixolydian | c | n | c | n | c | s | s | c | s | s | c | n |
| | Aeolian | c | n | c | c | n | s | n | c | s | n | c | n |
| | result | c | n | c | n | n | s | n | c | s | n | c | n |

Thus, key-codes of the accompaniment pattern are classified into the attributes (c, s, n) in accordance with the chord detected for production of the accompaniment pattern, and each note of the accompaniment pattern is converted in tone pitch in accordance with the attributes on a basis of note conversion tables shown in FIGS. 5A–5C. As a result, an optimal tone pitch conversion can be effected regardless of the kind of the accompaniment pattern. As is understood from the table, even if the type of chord and the tone name each are the same, there is a case in which different attributes are determined for different scales. Accordingly, in case the same attributes are determined for all the scales in the same type of chord with respect of each tone name, the attributes are adapted to the tone pitch conversion. In case plural attributes are determined for all the scales in the same type of chord, a non-scale tone is adapted to the tone pitch conversion even if one of the attributes is a non-scale tone (n). Provided that there is not any mixture of the chord tone and the scale tone. When the attributes have been determined as described above, attributes of each tone name for each type of chord are determined as shown in a column of "Result" in the table. Thus, it is able to obtain a classification table corresponding with one attribute with respect to the type of chord and the tone name.

Illustrated in FIG. 4 is an example of the classification table produced on a basis of the foregoing manner, wherein each tone name (C, C#, D, D#, . . . ) is classified as a chord tone (c), a scale tone (s) or a non-scale tone (n) with respect to each type (TP) of chord. The classification table is memorized in a classification table memory 9 shown in FIG. 1.

In FIGS. 5(A)–5(C), there are illustrated each example of the note conversion tables which are memorized as a table NTT(AT, TP, NT) in a note conversion table 10 shown in FIG. 1. In the note conversion tables, shift data (0, –1, –2, . . . ) of a key-code are stored in an array register where an index (AT), the type (TP) of chord and a note-code (NT) are adapted as argument in accordance with the attributes. The note conversion tables of FIGS. 5(A)–5(C) are provided for the chord tone (c), the scale tone (s) and the non-scale tone (n), respectively. In the note conversion table of FIG. 5(A), four half notes are adapted in maximum in downward shifting of the chord tone, and seven half notes are adapted in maximum in upward shifting of the chord tone.

By using the foregoing setting table, classification table and note conversion tables, the CPU 1 executes the following processing. First of all, the CPU 1 is applied with an accompaniment pattern from the external automatic performance device B and refers to the currently selected setting table on a basis of a channel number included in a key-on data of the accompaniment pattern to detect a chord or an original chord produced for the accompaniment pattern. Subsequently, the CPU 1 refers to the classification table on a basis of key-codes of the accompaniment pattern to classify the key-codes into either a chord tone (c), a scale tone (s) or a non-scale tone (n) in accordance with the type of the original chord. Thus, the CPU 1 converts in tone pitch the key-codes with reference to the note conversion table corresponding with the classification. In this instance, various kinds of rhythm patterns are preset in a rhythm pattern memory 11 shown in FIG. 1. Thus, the CPU 1 executes interruption processing in response to an interruption signal applied from the timer 12 to read out information of the rhythm patterns in accordance with a style selected by operation of the operation element 5 and applies the read out information to the sound source C. This causes the sound source C to produce a rhythm tone.

Figure 6:
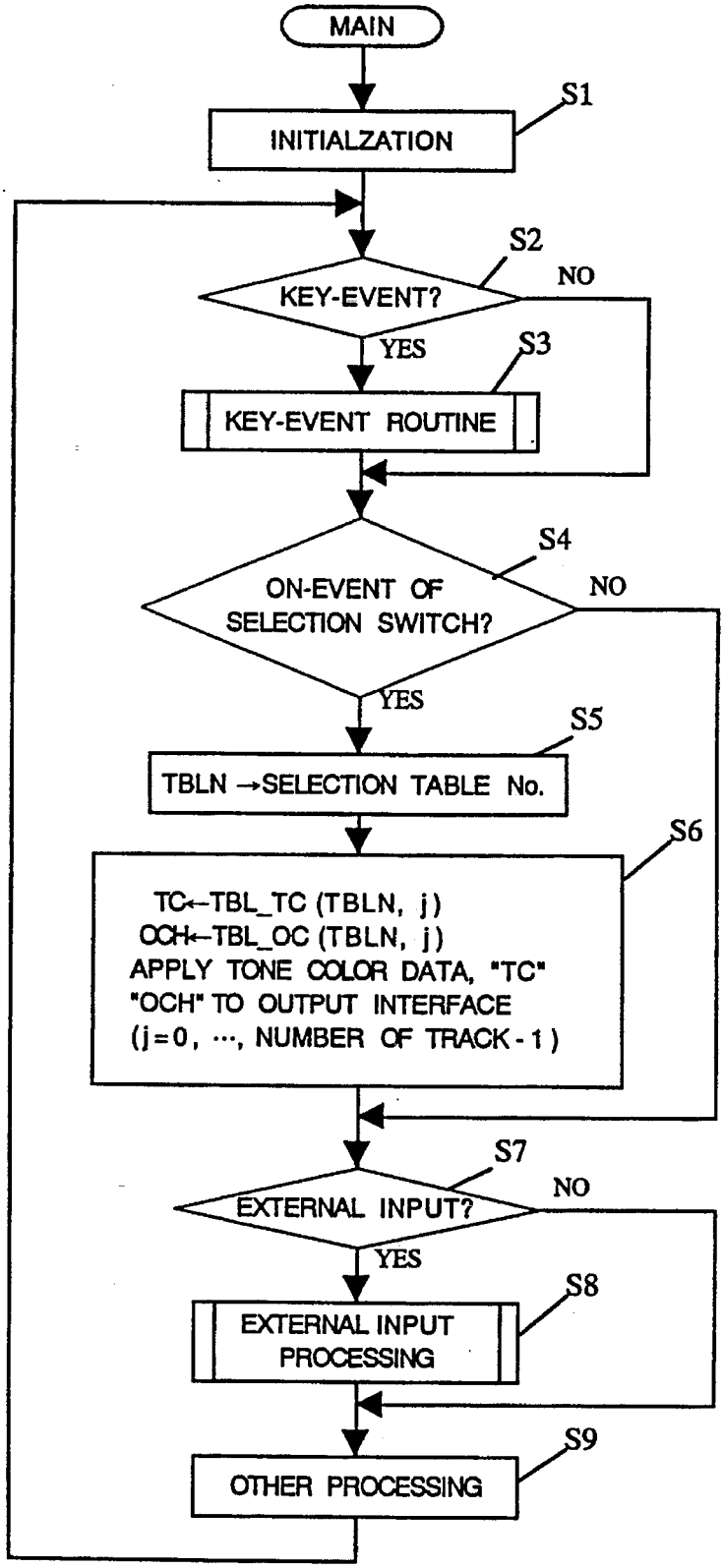
FIG. 6 is a flow chart of a main routine of a control program to be executed by a central processing unit shown in FIG. 2.
Figure 8:
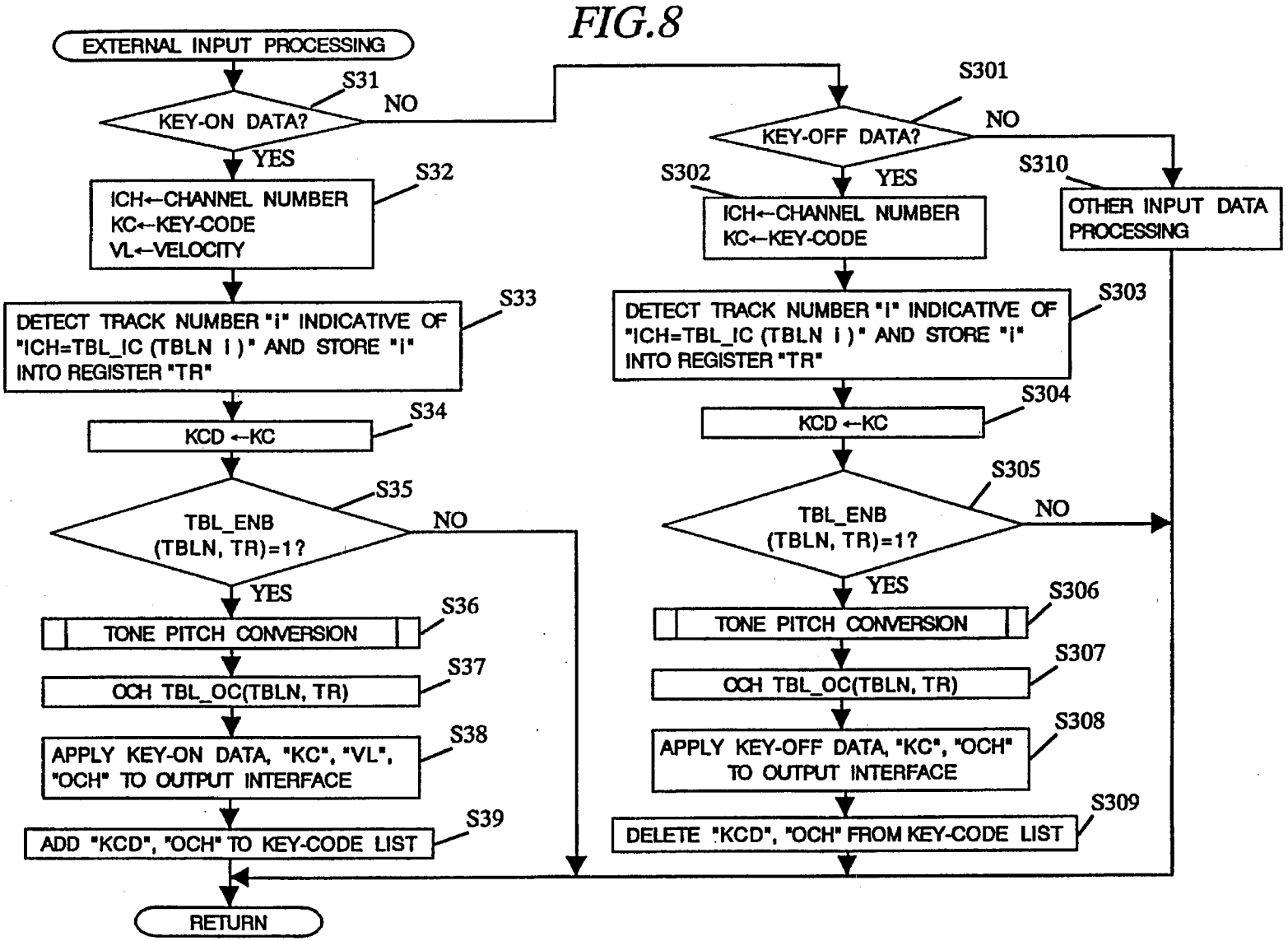
FIG. 8 is a flow chart of an external input routine of the control program.
Figure 9:
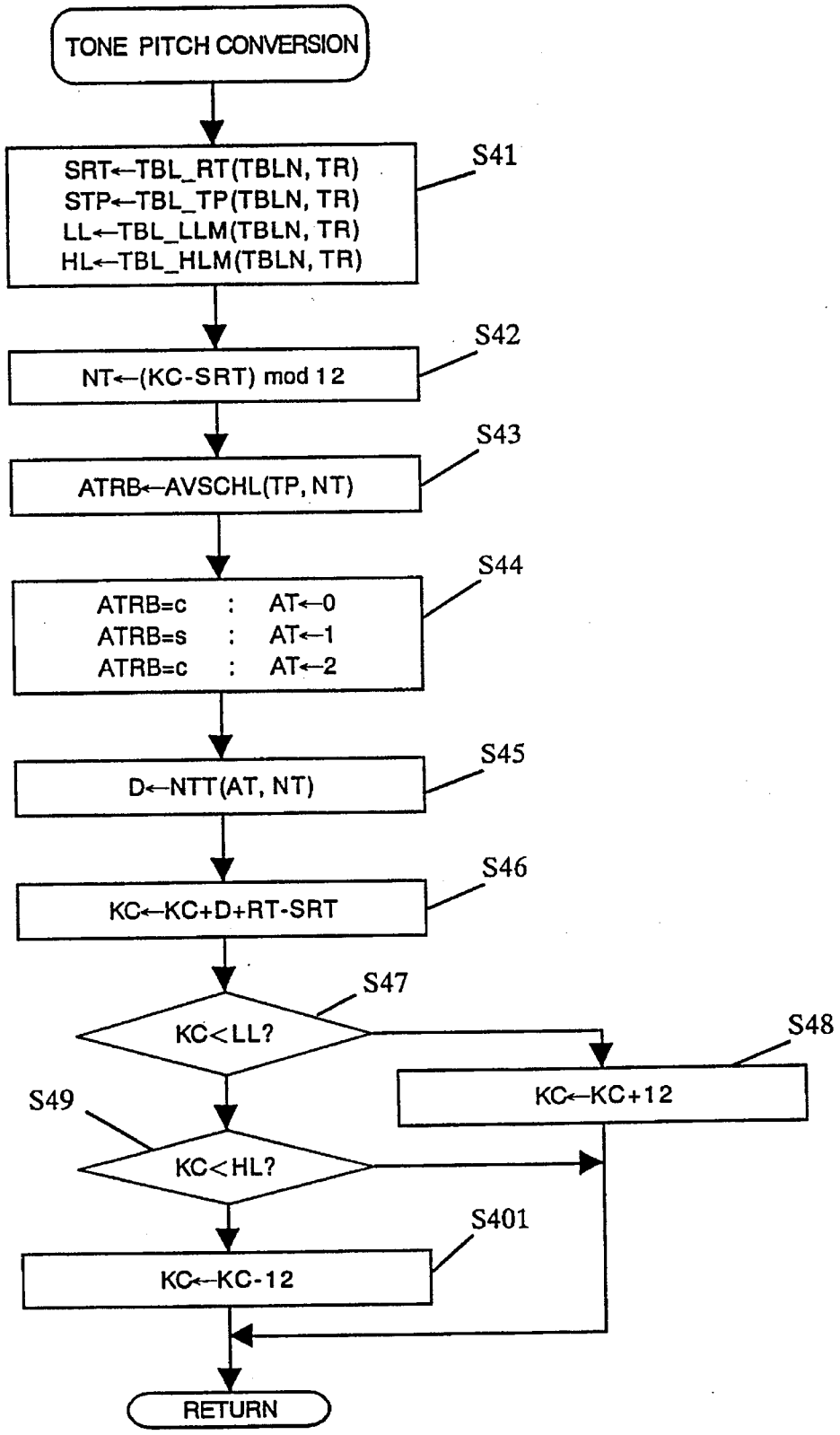
FIG. 9 is a flow chart of a tone pitch conversion routine of the control program.

In FIG. 6 there is illustrated a flow chart of a main routine of a control program to be executed by the CPU 1. In FIGS. 7–9 there are illustrated flow charts of subroutines of the control program. In the flow charts and the following description, registers and flags used for execution of the control program are represented as listed below.

TC: Register of a tone color channel

RT: Register of detected chord

TP: Register of the type of the detected chord

SRT: Register of the root of an original chord

STP: Register of the type of the original chord

TBLN: Register of a selected setting table number

ICH: Register of an input channel number of an accompaniment pattern

OCH: Register of an output channel number of the accompaniment pattern

NT: Register of a note-code of a key-code of the accompaniment pattern

TBL_ENB (m, k): an enable flag of the setting table

TBL_IC (m, k): Register of an input channel number in the setting table

TBL_OC (m, k): Register of an output channel number in the setting table

TBL_TC (m, k): Register of a tone color number in the setting table

TBL_RT (m, k): Register of the root of the original chord in the setting table

TBL_TP (m, k): Register of the type of the original chord in the setting table

TBL_LLM (m, k): Register of a lower limit tone in the setting table

TBL_HLM (m, k): Register of an upper limit tone in the setting table (provided that the character "m" is a selected setting table number, and the character "k" is a track number)

AVSCHL (TP, NT): Classification table

NTT (TP, NT): Note conversion table

D: Register of a shift data of the note conversion table

ATRB: Classified attribute (c, s, n)

AT: Index for corresponding the attribute with the note conversion table

N: Counter of a key-code list

VL: Register of velocity

LL: Register of a lower limit tone

HL: Register of an upper limit tone

Assuming that a power source switch (not shown) has been closed, the CPU 1 is activated to initiate execution of the main routine of the control program shown in FIG. 6 and initializes the flags and registers at step S1. At the following step S2, the CPU 1 determines presence of a key-event on the keyboard 4. If the answer at step S2 is "No", the program proceeds to step S4. If the answer at step S2 is "Yes", the program proceeds to step S3 where the CPU 1 executes processing of a key-event routine shown in FIG. 7 and causes the program to proceed to step S4. At step S4, the CPU 1 determines whether an on-event of the selection switch of the operation element 5 is present or not. If the answer at step S4 is "No", the program proceeds to step S7. If the answer at step S4 is "Yes", the program proceeds to step S5 where the CPU 1 stores a selected setting table number in register TBLN and causes the program to proceed to step S6.

At step S6, the CPU 1 stores a tone color number TBL TC (TBLN, j) in register TC with respect to all the tracks (j =0, . . . , the number of tracks–1) and stores an output channel number TBL OC (TBLN, j) in register OCH thereby to apply the tone color data, TC, OCH to the output interface 7. At the following step S7, the CPU 1 determines whether the input interface 6 has been applied with an external input or not. If the answer at step S7 is "No", the program proceeds to step S9. If the answer at step S7 is "Yes", the program proceeds to step S8 where the CPU 1 executes processing of the external input and causes the program to proceed to step S9. At step S9, the CPU 1 executes processing for output requirement of an accompaniment pattern to the external automatic performance device B, processing for a switch-event of the operation element 5 and so forth.

As described above, processing for the key-event of the keyboard 4, processing for selection of the setting table, and processing for input of the accompaniment pattern from the external automatic performance device B are conducted. Based on the selection of the setting table, the tone color data, TC, OCH are applied to the sound source C through the output interface 7 so that tone colors set in the setting table of the sound source are allotted to the corresponding channels. This causes the sound source C produce a musical sound of the tone color corresponding with the designated channel number.

During execution of the key-event routine shown in FIG. 7, the CPU 1 determines at step S21 whether the key-event is caused at the left-hand key area or not. If the answer at step S21 is "No", the CPU 1 executes sound processing or mute processing at step S22 and returns the program to the main routine. If the answer at step S21 is "Yes", the CPU 1 executes processing for chord detection based on a key-code of the key-event at step S23 and determines at step 24 whether a chord has been detected or not. If the answer at step S24 is "No", the program returns to the main routine. If the answer at step S24 is "Yes", the CPU 1 stores at step 525 the data of the register RT into a register ORT and stores the data of the register TP into a register OTP. At the following step S26, the CPU 1 stores the root of the detected chord into the register RT and stores the type of the detected chord into the register TP.

When the program proceeds to step S27, the CPU 1 determines whether the data of register ORT is not identical with "F" of 16 notation, whether the data of register ORT is identical with the data of register RT or not, and whether the data of register OTP is identical with the data of register TP or not. That is, the CPU 1 determines at step S27 whether the chord detected just before is identical with the current chord or not. If the answer at step S27 is "No", the program returns to the main routine. If the answer at step S27 is "Yes", the program proceeds to step 28 where the CPU 1 executes mute processing at the accompaniment channel of the sound source C and causes the program to proceed to step S201 after set the counter N to "1" at step S29.

At step S201, the CPU 1 determines whether the number of elements in the key-code list is less than "N" or not. If the answer at step S201 is "No", some elements remain in the key-code list without being processed. Thus, the program proceeds to step S202 where the CPU 1 reads out the key-code of the "N" number element from the key-code list to store the key-code into the register KC and reads out the output channel of the "N" number element from the key-code list to store the output channel number into the register OCH. Thereafter, the CPU 1 executes at step S203 processing of the tone pitch conversion routine shown in FIG. 9.

After processing of the tone pitch conversion routine at step S203, the CPU 1 sets at step S204 the velocity VL as a predetermined value and applies at step S205 the key-on data, KC, VL and OCH to the output interface 7 as a MIDI signal. Subsequently, the CPU 1 adds "1" to the counter N at step S206 and returns the program to step S 201. If the answer at step S201 is "Yes", the program returns to the main routine. With the foregoing processing, the sound processing or mute processing of the key-event at the right-hand area of the keyboard 4 is executed, and the chord detection at the left-hand area is conducted. Thus, a musical sound is produced at the sound source C with respect to the key-codes in the key-code list and the output channel.

During execution of the external input routine shown in FIG. 8, the CPU 1 determines at step S31 whether the command signal of the input accompaniment pattern is a key-on data or not. If the answer at step S31 is "No", the program proceeds to step S301 where the CPU 1 determines whether the command signal of the input accompaniment pattern is a key-off data or not, If the answer at step S301 is "No", the program proceeds to step S310 where the CPU 1 executes processing of other data and returns the program to the main routine. If the answer at step S31 is "Yes", the CPU 1 executes processing at step S32–S39. If the answer at step S301 is "Yes", the CPU 1 executes processing at step S302–S309.

When the program proceeds to step S32, the CPU 1 stores the channel number of the command signal, the key-code and the velocity into the registers ICH, KC and VL, respectively. At the following step S33, the CPU 1 searches the setting table selected by the current selection number TBLN to detect a track number i indicative of "ICH=TBL_IC (TBLN, i)" and stores the detected track number i into a register TR. Subsequently, the CPU 1 stores at step S34 the input key-code KC into one end of a register KCD and determines at step S35 whether "TBL_ENB (TBLN, TR) is "1" or not, i.e. whether the detected track Is valid or not. If the detected track is invalid, the program returns to the main routine. If the detected track is valid, the CPU 1 determines a "Yes" answer at step S35 and executes at step S36 processing of the tone pitch conversion routine shown in FIG. 9.

When the processing of the tone pitch conversion routine has finished at step S36, the CPU 1 stores at step S37 the output channel number TBL_OC.(TBLN, TR) into the register OCH and applies at step S38 the key-on data, KC, VL, OCH to the output interface 7 as a MIDI signal. At the following step S39, the CPU 1 adds KCD, OCH to the key-code list and returns the program to the main routine. In case the command signal of the input accompaniment pattern is a key-off data, the program proceeds to step S302 where the CPU 1 stores the channel number of the command signal into the register ICH and stores the key-code into the register KC. Thereafter, the CPU 1 executes processing at step S303–S307 in the same manner as the processing at step S33–S37. When the program proceeds to step S308, the CPU 1 applies the key-off data, KC, OCH to the output interface 7 as a MIDI signal. At the following step S309, the CPU 1 deletes KCD, OCH from the key-code list and returns the program to the main routine.

With the foregoing processing, the CPU 1 detects the track of the setting table corresponding with the MIDI channel designated by the command signal when applied with the accompaniment pattern from the external automatic performance device B and executes the processing of the tone pitch conversion routine of FIG.9 in accordance with the contents of the track. When the command signal of the accompaniment pattern is a key-off data, the CPU 1 causes the sound source C to mute a musical sound based on the key-code converted at the sound source C. In this instance, the CPU 1 deletes the converted key-code and the channel number from the key-code list. When the command signal of the accompaniment pattern is a key-on data, the CPU 1 causes the sound source C to produce a musical sound based on the key-code converted at the sound source C. In this instance, the CPU 1 adds the converted key-code and the channel number to the key-code list.

During execution of the tone pitch conversion routine shown in FIG. 9, the CPU 1 stores at step S41 the root TBL RT (TBLN, TR) of the original chord, the type TBL TP (TBLN. TR) of the original chord, the lower limit tone TBL LLM (TBLN, TR) and the upper limit tone TBL HLM (TBLN, TR) into the registers SRT, STP, LL, HL, respectively with respect to the track detected from the currently selected setting table. At the following step S42, the CPU 1 shifts the key-code KC (or the key-code of the key-code list) with the root SRT of the original chord and Stores a note-code of the shifted key-code into the register NT. In this instance, the key-code KC is converted into the note-code by calculation of "(KC–SRT) mod 12". The note-code is applied to each tone name as a sign of one octave ("B"=11) which increases with "1" at each time when the tone name C is set as "0" and raised with half note.

Subsequently, the CPU 1 stores at step S43 the type TP of the detected chord and the data AVSCHL (TP, NT) of the classification table corresponding with the note-code NT into the register ATRB and sets the index AT as "0" when "ATRB=c (a chord tone)" is satisfied. In addition, the CPU 1 sets the index AT as "1" when "ATRB=s (a scale note)" is satisfied and sets the index AT as "2" when ATRB=n (a non-scale tone) is satisfied. Thus, the CPU 1 selects the note conversion table in accordance with the attribute ATRB and causes the program to proceed to step S45. At step S45, the CPU 1 reads out the shift data NTT (AT, TP, NT) corresponding with the type TP of the detected chord and the note-code NT from the note conversion table selected by the index AT and stores the readout shift data NTT into the register: D. At the following step S46, the CPU 1 adds the shift data D and the root RT of the detected chord to the key-code KC and subtracts the root SRT of the original chord to convert the key-code KC in tone pitch.

When the program proceeds to step S47, the CPU 1 determines whether "KC" is lower in tone pitch than "LL" or not. If the key-code KC is lower in tone pitch than the lower limit tone LL, the CPU 1 determines a "Yes" answer at step S47 and converts at step S48 the key-code KC into a key-code (KC+12). Thus, the CPU 1 stores the converted key-code code KC into the register KC and returns the program to the main routine. If the key-code KC is higher in tone pitch than the lower limit tone LL, the CPU 1 determines a "No" answer at step S47 and determines at step S49 whether "KC" is higher in tone pitch than "HL" or not. If the key-code KC is lower in tone pitch than the upper limit tone HL, the CPU 1 determines a "No" answer at step S49 and returns the program to the main routine. If the key-code KC is higher in tone pitch than the upper limit tone HL, the CPU 1 determines a "Yes" answer at step S49 and converts the key-code KC in tone pitch into a key-code (KC–12) at step S401. Thus, the CPU 1 stores the converted key-code into the register KC and returns the program to the main routine.

With the foregoing processing, the CPU 1 applies the automatic accompaniment information to the sound source C in accordance with the timing of the MIDI signal when applied with the accompaniment pattern from the external automatic performance device B and the chord produced at the left-hand area of the keyboard 4. This causes the sound source to sound an accompaniment tone. Thus, an automatic accompaniment is conducted on a basis of an appropriate accompaniment pattern produced by the external automatic performance device B. In addition, the key-code converted in tone pitch is restricted in a range between the upper limit tone and the lower limit tone. Accordingly, the tone pitch of the accompaniment pattern does not become in excess high or low. As a result, the accompaniment can be naturalized.

In this embodiment, the key-code of the accompaniment pattern is classified in accordance with attributes of the tone name such as the chord tone, scale tone and non-scale tone and converted in tone pitch on a basis of the note conversion table. This is useful to effect tone pitch conversion musically suitable for the accompaniment pattern even if a different accompaniment pattern is converted on a basis of the same note conversion table. Accordingly, it is not required to produce the note conversion table for each accompaniment pattern or to produce the accompaniment pattern based on a predetermined chord. Thus, even if the accompaniment pattern is produced by a user on a basis of a desired original chord, the same note conversion table can be adapted to effect tone pitch conversion of the accompaniment pattern.

Although in the above embodiment, the chord is detected by the key-code of the event-key on the keyboard 4, the chord may be detected by a key-code data applied from an external device such as the external automatic performance device B. Although the setting table has been selected by a user, the setting table may be selected by a table selection data corresponding with the accompaniment pattern applied from the external automatic performance device B. In addition, the contents of the setting table may be applied by the user, and also the automatic accompaniment information produced by tone pitch conversion may be memorized in an appropriate memory means.

From the above description, it will be understood that in the automatic accompaniment information producing apparatus of the present invention, tone pitch information of the accompaniment pattern supplied from the external performance device is converted in accordance with the input chord to produce the automatic accompaniment information. That is, the automatic accompaniment information is converted into tone pitch information of an accompaniment tone to be actually produced. Thus, the accompaniment tone is reproduced at the sound source in a simple manner, and the automatic accompaniment can be conducted in various variation by supply of an appropriate accompaniment pattern.

What is claimed is:

1. An automatic accompaniment information producing apparatus, comprising:

first input means for receiving tone pitch information of an accompaniment pattern from an external device, said first input means comprising a plurality of channels;

second input means for receiving a designating chord;

supply means for supplying an original chord based on the accompaniment pattern and corresponding with each channel of said first input means;

tone pitch conversion means for converting in tone pitch the tone pitch information of the accompaniment pattern in accordance with the designation chord and the original chord respectively supplied from said second input means and said supply means; and output means for producing the converted tone pitch information of the accompaniment pattern as automatic accompaniment information.

2. An automatic accompaniment information producing apparatus as claimed in claim 1 wherein said supply means comprises:

memory means for storing a plurality of setting tables to be selected by a user in accordance with the accompaniment pattern, each of said setting tables being capable of storing a root and a type of an original chord to be designated by the user for producing the accompaniment pattern.

3. An automatic accompaniment information producing apparatus comprising:

input means for inputting tone pitch information of an accompaniment pattern from an external device;

means for selecting one of a plurality of original chords;

designation means for designating a designation chord;

determining means for determining attributes of said tone pitch information input by said input means based on said selected original chord and said tone pitch information input by said input means;

tone pitch changing means for changing said tone pitch information input by said input means in accordance with said selected original chord, said designation chord designated by said designating means, and said attributes determined by said determining means; and output means for outputting said tone pitch information changed by said tone pitch changing means as automatic accompaniment information.

4. An automatic accompaniment information producing apparatus as claimed in claim 3 wherein said tone pitch information input by said input means comprises a sequence of note codes.

5. An automatic accompaniment information producing apparatus as claimed in claim 4 wherein said detection means detects an attribute for each note code in said tone pitch information input by said input means.

6. An automatic accompaniment information producing apparatus as claimed in claim 5 wherein said tone pitch changing means changes a tone pitch of each note code in said tone pitch information input by said input means.

7. An automatic accompaniment information producing apparatus as claimed in claim 4 wherein said means for selecting an original chord comprises memory means for storing a plurality of setting tables to be selected by a user, each of said setting tables comprising a plurality of original chords and for each said original chord a root and type of said original chord.

8. An automatic accompaniment information producing apparatus as claimed in claim 3 wherein said determining means comprises:

memory means for storing a classification table comprising a plurality of tone pitch names for each of a plurality of original chord types, wherein for each original chord type, each tone pitch name is classified as a chord constituent tone, a scale tone, or a non-scale tone; and means for reading said classification table to determine said attributes of said tone pitch information input.

9. An automatic accompaniment information producing apparatus as claimed in claim 3 wherein said tone pitch changing means comprises:

memory means for storing a plurality of note conversion tables, each said note conversion table comprising tone shift data for each of a plurality of tone pitch names and each of a plurality of original chord types.

10. A method for producing automatic accompaniment information comprising said steps of:

inputting tone pitch information of an accompaniment pattern from an external device;

selecting one of a plurality of original chords;

designating a designation chord;

determining attributes of said tone pitch information based on said selected original chord and said tone pitch information;

changing said tone pitch information in accordance with said selected original chord, said designation chord, and said determined attributes; and outputting said changed tone pitch information as automatic accompaniment information.

11. A method for producing automatic accompaniment information as claimed in claim 10, wherein said step of designating a designation chord comprises designating a chord produced in a real time by operation of a keyboard.

* * * * *